US009468247B2

(12) United States Patent
Nunna et al.

(10) Patent No.: US 9,468,247 B2
(45) Date of Patent: Oct. 18, 2016

(54) GRADUATION MORTARBOARD DISPLAY HOLDER

(71) Applicant: California State University Fresno, Fresno, CA (US)

(72) Inventors: Ramakrishna Nunna, Fresno, CA (US); Walter Mizuno, Reedley, CA (US)

(73) Assignee: California State University, Fresno, Fresno, CA (US)

( * ) Notice: Subject to any disclaimer, the term of this patent is extended or adjusted under 35 U.S.C. 154(b) by 229 days.

(21) Appl. No.: 13/862,292

(22) Filed: Apr. 12, 2013

(65) Prior Publication Data

US 2014/0305014 A1 Oct. 16, 2014

(51) Int. Cl.

| | |
|---|---|
| ***G09F 3/06*** | (2006.01) |
| ***A42B 1/24*** | (2006.01) |
| *G09F 3/16* | (2006.01) |

(52) U.S. Cl.

CPC ..... *A42B 1/248* (2013.01); *G09F 3/06* (2013.01); *G09F 3/16* (2013.01)

(58) Field of Classification Search

CPC ..... G09F 3/06; G09F 3/16
USPC ..... 40/658, 666, 328, 586, 32; 248/104, 248/126, 229.1, 229.11; 116/173
See application file for complete search history.

(56) References Cited

U.S. PATENT DOCUMENTS

| | | | | |
|---|---|---|---|---|
| 1,810,542 | A * | 6/1931 | Trupiano | D06F 55/00 24/557 |
| 2,995,758 | A | 8/1961 | La Maida | |
| 3,787,922 | A * | 1/1974 | Foy et al. | 16/404 |
| 4,866,868 | A * | 9/1989 | Kass | G09F 3/204 40/651 |
| 4,882,862 | A * | 11/1989 | Slavsky, Sr. | G09F 1/10 40/324 |
| 4,884,350 | A * | 12/1989 | Whetstone | 40/124 |
| 5,033,528 | A * | 7/1991 | Volcani | 160/351 |
| 5,463,189 | A * | 10/1995 | Deneke et al. | 174/138 G |
| 5,463,974 | A * | 11/1995 | Seeder | 116/173 |
| 5,549,268 | A * | 8/1996 | Hopwood | 248/442.2 |
| 5,697,594 | A | 12/1997 | Adams | |
| 6,085,687 | A * | 7/2000 | Chester | 116/173 |
| 6,742,757 | B2 * | 6/2004 | Fox | 248/538 |
| D616,946 | S | 6/2010 | Garfinkle | |
| 2007/0033705 | A1 | 2/2007 | Dickson | |
| 2013/0025028 | A1 | 1/2013 | Goldberg | |

* cited by examiner

*Primary Examiner* — Syed A Islam
(74) *Attorney, Agent, or Firm* — Grace Liu

(57) ABSTRACT

A mortar board display holder comprises a board clip portion, a display supporter portion, and a connecting portion joining the board clip portion and the display supporter portion. The board clip portion has a flat upper prong having a first plane, a flat lower prong having a second plane, and a spacing member that holds the upper prong fixably spaced from the lower prong such that the second plane is substantially parallel to the first plane. The display supporter portion has a flat first leg having a third plane, a flat second leg having a fourth plane, and a holding member that holds the first leg and the second leg such that the third plane is substantially parallel to the fourth plane. The display supporter portion may further comprise a neck adjacent to and connected to the holding member, and an elongated arm adjacent to and connected to the neck. The neck may be straight or curved. The connecting portion may involve the elongated arm on the display supporter portion engaging with the board clip portion.

1 Claim, 6 Drawing Sheets

GRADUATION MORTARBOARD DISPLAY HOLDER

BACKGROUND OF THE INVENTION

1. Field of the Invention

Mortarboards are worn as headgear on the heads of proud graduating students as they present during their graduation exercises. Mortarboards are solid colored caps having a flat top that is substantially square in shape, with draped cloth protruding from the underside of the flat portion to secure the cap to the wearer's head. Some graduating students embellish the tops of mortarboards with drawings, pictures, and other decorations.

Clips are used to securely attach one object to another object, often with one object acting as the supporting platform on which the second object is displayed.

2. Description of the Related Art

During graduation exercises, the graduating students are dressed uniformly in matching robes and mortarboards. From certain angles, the broad mortarboards can obscure the faces of graduating students. Parents, friends and loved ones have difficulty distinguishing the graduating student of interest in large graduating classes due to the uniformity of dress and the mortarboard acting to block facial features. Also, many graduating students chafe at the forced uniformity of graduation dress. Some wish to express their individuality during one of the most important days of their lives.

To express some individuality, some graduating students embellish the top of their respective mortarboards by drawing on or gluing designs to them. These modifications are generally permanent. Since many graduating students rent or borrow graduation outfits, permanent modification of the top of the rented or borrowed mortarboard is undesirable.

What is needed is a simple and non-permanent way for graduating students to individualize their mortarboards to make it easier for their loved ones to spot the individual in a crowd, and to express the wearer's messages, feelings, and sentiments on graduation day.

There is no prior art for mortar board display holders. However, there are prior art references teaching mortar board embellishments, as well as prior art references teaching various clip configurations. None of the prior art references teach the important features and functions of this invention.

U.S. Patent Application Publication 2007/0033705 A1 teaches a removable graduation cap cover that fits over the entire top of the mortarboard. The cap cover is made of a flexible material that stretches around the entire top surface of the mortarboard and fastens on the mortarboard underside. The removable graduation cap cover allows the wearer to customize the top of his/her mortarboard in a unique way. While the removable cover provides a means to customize the mortarboard, the removable cover cannot hold any documents, signs, drawings, and/or photographs. The removable cover does not provide any means to hold and display anything other than itself to the top of a mortarboard. Also, the removable cover lies flat against the top surface of the mortarboard and cannot display any design in an angled fashion with respect to the mortarboard plane.

U.S. Patent Application Publication 2013/0025028 teaches a graduation cap top that is removably secured to a graduation cap. The graduation cap top includes a flat base, and a design surface with a connection means to attach to the top surface of the mortarboard. The design surface is on top of the flat base, and the flat base attaches to the top surface of the mortarboard. The connection means can be velcro, putty, double sided tape, or magnets. While the graduation cap top allows the graduating student to put a customized message or design on top of the mortarboard, the mortarboard surface is still likely to be altered by the connection means. Any velcro, putty, tape, or magnets take time to attach to the mortarboard and will likely damage the surface of the mortarboard. Also, the graduation cap top lies flat against the top surface of the mortarboard and cannot display any design in an angled fashion with respect to the mortarboard plane.

There are many prior art examples of clip configurations, but none suited to clipping to a mortarboard. U.S. Pat. No. 5,697,594 teaches a computer monitor document holder assembly. The '594 patent teaches two clips, one that can clip to a mortarboard, and one that can clip to a document, sign, drawing, display, or photograph. However, since both clips in the document holder assembly are spring biased, it is likely that the clip edge contacting the mortarboard will squish and damage the mortarboard, leaving an indentation. Also, the computer monitor document holder assembly has non-securable hinges that will not hold the displayed document, sign, drawing, display or photograph in one desired orientation. It is desirable that a mortarboard display holder have a board clip containing a top and bottom prong that each lies flush against the surface of the mortarboard, and that can securely hold a document, sign, drawing, display or photograph in one desired orientation.

U.S. Design Pat. No. D616,946 teaches a tag holder with two clips securely oriented at 90 degrees to each other. The tag holder is intended to sit on a flat surface with the bottom surface of the larger bottom prong contacting a table or shelf. The tag display holder will be unbalanced if clipped onto a mortarboard—and will likely fall off of the mortarboard—because one end of the tag holder is so much heavier than the other. Ideally, the two clips would be oriented in a way that balances the entire clip assembly when clipped onto the edge of a mortarboard. Also, the bottom clip has a curved bottom prong that will likely cause the bottom clip to bend a mortarboard if attached thereto.

What is needed is a clip assembly capable of securely attaching to a mortarboard in a non-permanent way that will not damage the surface of the mortarboard, and securely holding documents, signs, drawings, and/or photographs such that the plane of the document, sign, drawing, and/or photograph is in angular relation to the plane of the mortarboard.

SUMMARY OF THE INVENTION

This invention is a mortar board display holder comprising a board clip portion, a display supporter portion, and a connecting portion joining the board clip portion and the display supporter portion. The board clip portion has a flat upper prong having a first plane, a flat lower prong having a second plane, and a spacing member that holds the upper prong fixably spaced from the lower prong such that the second plane is substantially parallel to the first plane. The display supporter portion has a flat first leg having a third plane, a flat second leg having a fourth plane, and a holding member that holds the first leg and the second leg such that the third plane is substantially parallel to the fourth plane.

The board clip portion may have an upper prong that is rectangular, triangular, or trapezoidal in shape. Likewise, the lower prong may be rectangular, triangular, or trapezoidal in shape. The upper prong and the lower prong may each have an interior surface containing a plurality of ridges. The plurality of ridges on either upper prong or lower prong may number between 2 and 8, and preferably may number between 4 and 6. The plurality of ridges of both upper prong and lower prong may number between 2 and 8, and preferably may number between 4 and 6.

The mortarboard display holder may have an upper prong with an upper back edge, a lower prong with a lower back edge, and a spacing member that is substantially U-shaped and that joins the upper back edge to the lower back edge. Alternatively, the spacing member may have a top portion and a bottom portion, wherein the top portion has a shape and the bottom portion has a shape, and wherein the top portion shape and the bottom portion shape are substantially triangular.

The display supporter portion may have a first leg and a second leg wherein each has an interior surface containing a plurality of ridges. The plurality of ridges on either first leg or second leg may number between 2 and 8, and preferably may number between 4 and 6. The plurality of ridges of both first leg and second leg may number between 2 and 8, and preferably may number between 4 and 6.

The display supporter portion may further comprise a neck adjacent to and connected to the holding member, and an elongated arm adjacent to and connected to the neck. The elongated arm may comprise a first arm portion and a second arm portion. The neck may be straight or curved. In one aspect of the invention, the neck can be fixably adjusted such that the first plane and the third plane form an angle of between about 0 and about 90 degrees. In one aspect of the invention, the neck is fixed such that the first plane and the third plane form an angle of between about 0 and about 90 degrees.

The board clip portion may further have a receiving well on the upper prong, and wherein the elongated arm extends into and fixably secures within the receiving well. In one aspect, the upper prong has a cross section and the receiving well extends through the cross section of the upper prong. The receiving well may have an interior surface, and the first arm portion and the second arm portion may bias against the interior surface.

The mortarboard display holder may be of unitary construction.

DETAILED DESCRIPTION OF THE INVENTION AND PREFERRED EMBODIMENTS

Figure 1A:
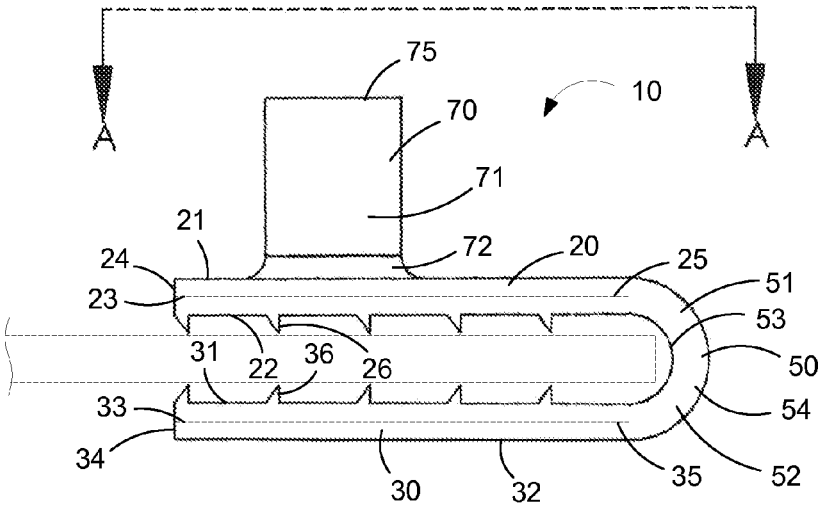
FIG. 1A shows a side view of an edge clip, a board clip portion with a straight spacer designed to allow the edge clip to attach to a mortar board edge.

Reference now will be made in detail to various embodiments of the invention, examples of which are illustrated in the accompanying drawings. While the invention will be described in conjunction with the following embodiments, it will be understood that the descriptions are not intended to limit the invention to these embodiments. Furthermore, in the following detailed description, numerous specific details are set forth in order to provide a thorough understanding of the present invention. However, it will be readily apparent to one of ordinary skill in the art that the present invention may be practiced without these specific details.

The invention is a mortar board display holder that has a board clip portion that clips to a mortarboard, and a display supporter portion that supports a displayed document, sign, drawing, photograph, or display. The invention also includes a connecting portion that joins the board clip portion to the display supporter portion. The mortar board display holder may be of unitary construction, or may be constructed of a plurality of parts that can be fixably assembled together.

In one embodiment, the mortar board display holder has a board clip portion that is an edge clip that is designed to attach anywhere on any one of the four edges of the mortar board. In another embodiment, the mortarboard display holder has a board clip portion that is a corner clip that is designed to attach to any one of the four corners of the mortar board. In yet another embodiment, the mortar board display holder has a display supporter portion that is a straight supporter to hold a displayed document, sign, drawing, photograph, or display perpendicularly with respect to the plane of the mortarboard. In still another embodiment, the mortarboard display holder has a display supporter portion that is a curved supporter to hold a displayed document, sign, drawing, photograph, or display in parallel with respect to the plane of the mortarboard.

By assembling the desired embodiment of the board clip portion with the desired embodiment of the display supporter portion, the user can customize where the displayed document, sign, drawing, photograph, or display is supported on the mortar board, and can customize the angle between the plane of the displayed item and the plane of the mortarboard. In one embodiment of the mortarboard display holder, the user can fixably adjust the angle between the plane of the displayed item and the plane of the mortarboard.

A. Board Clip Portion Configuration

The board clip portion may comprise an upper prong and a lower prong joined by a spacing member that holds each of the two prongs in place and spaced from each other. The spacing member may be a straight spacer adapted to fit against an edge of a mortarboard. Alternatively the spacer may be a triangular spacer adapted to fit against a mortarboard corner and the two adjoining edges. An edge clip is a board clip portion comprising an upper prong, a lower prong, and a straight spacer joining the two prongs. A corner clip is a board clip portion comprising an upper prong, a lower prong, and a triangular spacer joining the two prongs.

Figure 1B:
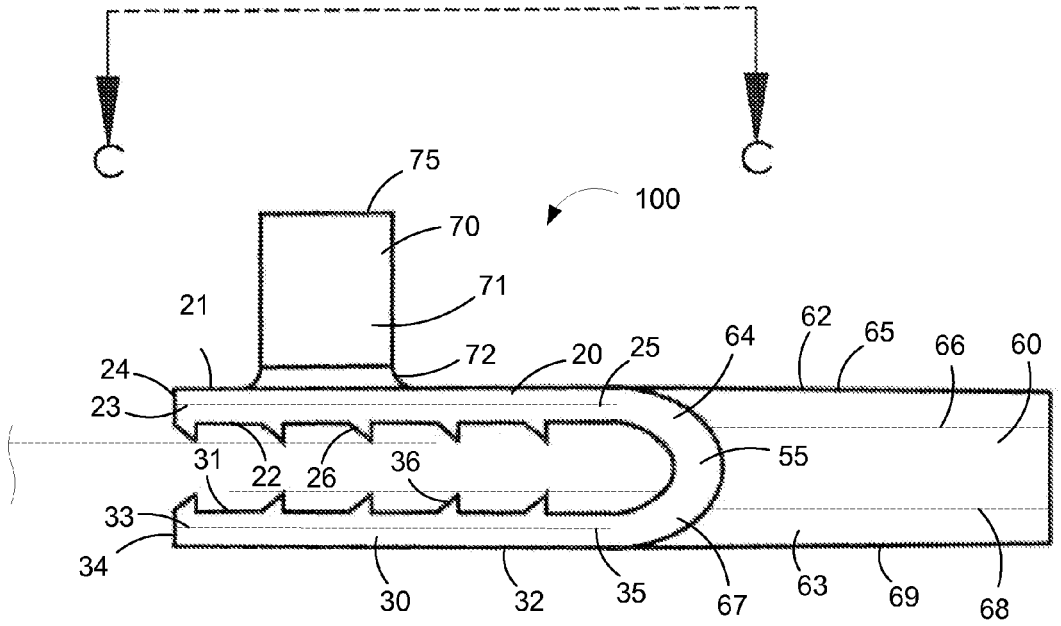
FIG. 1B shows a side view of a corner clip, a board clip portion with a triangular spacer designed to allow the corner clip to attach to a mortar board corner.
Figure 2A:
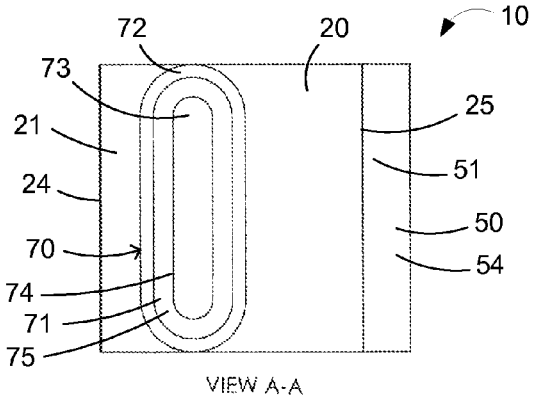
FIG. 2A shows the top view of an edge clip.
Figure 2B:
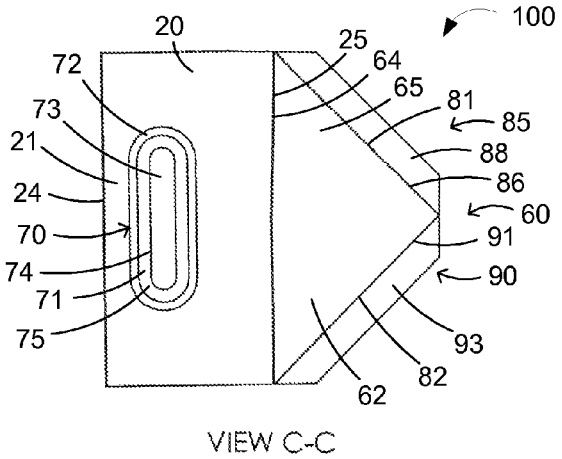
FIG. 2B shows the top view of a corner clip.

As shown in FIG. 1A and FIG. 2A, a board clip portion may be edge clip 10. As shown in FIG. 1B and FIG. 2B, a board clip portion may be corner clip 100. Edge clip 10 and corner clip 100 each has a flat upper prong 20 and a flat lower prong 30. The mortarboard is held between upper prong 20 and lower prong 30. A spacing member holds upper prong 20 fixably spaced from lower prong 30. Edge clip 10 and corner clip 100 each has receiving well 70 which is located on top of, and is supported by, upper prong 20. Receiving well 70 has wall 71 supported by base 72. Receiving well 70 is located on top surface 21 of upper prong 20. Edge clip 10 and corner clip 100 each may have a plurality of ridges on either upper prong or lower prong, or both upper and lower prongs. In one embodiment, edge clip 10 and corner clip 100 each has upper ridges 26 extending downwardly from upper prong 20 and lower ridges 36 extending upwardly from lower prong 30.

1. Upper Prong

As shown in FIG. 1A, and FIG. 2A, upper prong 20 is flat and has top surface 21 and bottom surface 22. Upper prong 20 has upper prong front edge 24 and upper prong back edge 25. Upper plane 23 extends throughout upper prong 20 and is equidistantly spaced from top surface 21 and bottom surface 22. Upper ridges 26 are attached to bottom surface 22, and extend downwardly therefrom. Upper ridges 26 may be a plurality of parallel ridges, numbering between 2 and 8 ridges, and ideally numbering between 4 and 6 ridges.

As shown in FIG. 2A and FIG. 2B, upper prong 20 has a shape when viewed from the top, and that shape may be square, rectangular, triangular, circular, oval, trapezoidal, or an irregular shape. Upper plane 23 extends through upper prong 20 no matter what its top view shape.

2. Lower Prong

Also as shown in FIG. 1A and FIG. 1B, lower prong 30 is flat and has top surface 31 and bottom surface 32. Lower prong 30 has lower prong front edge 34 and lower prong back edge 35. Lower plane 33 extends throughout lower prong 30 and is equidistantly spaced from top surface 31 and bottom surface 32. Lower ridges 36 are attached to top surface 31, and extend upwardly therefrom. Lower ridges 36 may be a plurality of parallel ridges, numbering between 2 and 8 ridges, and ideally numbering between 4 and 6 ridges.

Figure 2C:
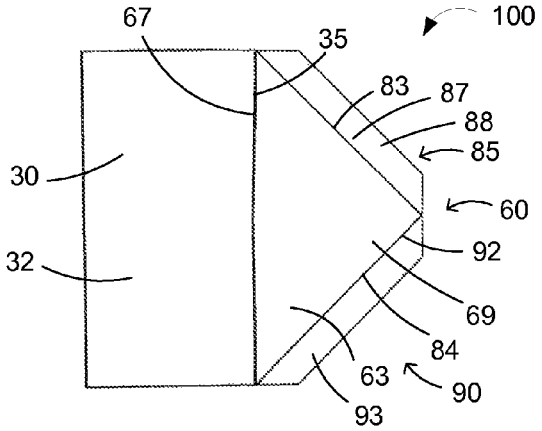
FIG. 2C shows a bottom view of a corner clip.

As shown in FIG. 2C, from a bottom view perspective, lower prong 30 has a shape, which may be square, rectangular, triangular, circular, oval, trapezoidal, or an irregular shape. Lower plane 33 extends through lower prong no matter what its bottom view shape.

3. Spacing Member

As shown FIGS. 1A and 1B, a spacing member holds upper prong 20 fixably spaced from lower prong 30 such that lower plane 33 lies below and substantially parallel to upper plane 23. For purposes of this invention, "substantially parallel" is defined as any angle between about 0 degrees and about 10 degrees, preferably less than 5 degrees. Spacing member may have two different embodiments, straight spacer 50 shown in FIG. 1A and FIG. 2A, and triangular spacer 60 shown in FIG. 1B, FIG. 2B, and FIG. 2C.

i. Edge Clip Configuration

As shown in FIG. 1A and FIG. 2A, when a board clip portion has straight spacer 50 securely joining upper prong 20 and lower prong 30, then the board clip portion is embodied as edge clip 10 adapted to clip anywhere along any one of the four edges of a mortarboard. Straight spacer 50 ensures that edge clip 10 does not damage a mortarboard surface, like scratching, bending or overly compressing the mortarboard. Moreover, straight spacer 50 ensures that edge clip 10 does not damage the mortarboard edge.

As shown in FIG. 1A and FIG. 2A, straight spacer 50 is an elongated U-shaped groove with two legs, first spacing leg 51 and second spacing leg 52. Straight spacer 50 also has spacing body 54 forming apex of U-shaped straight spacer 50. First spacing leg 51 fixably secures to upper prong back edge 25 and second spacing leg 52 fixably secures to lower prong back edge 35. Straight spacer 50 has an interior surface 53 that may contact and lie flush against an edge of a mortarboard. Spacing body 54 holds first spacing leg 51 and second spacing leg 52 in an orientation to accommodate the thickness of a mortarboard such that bottom surface 22 of upper prong 20 lies substantially flush against the top surface of the mortarboard, and top surface 31 of lower prong 30 lies substantially flush against the bottom surface of the mortarboard.

ii. Corner Clip Configuration

When a board clip portion has corner spacer 60 securely joining upper prong 20 and lower prong 30, then the board clip portion is embodied as corner clip 100 adapted to clip to any one of the four corners of a mortarboard. When corner clip 100 is clipped to a mortarboard, the mortarboard is situated under upper prong 20, above lower prong 30, and within corner spacer 60. Corner spacer 60 ensures that corner clip 100 does not damage a mortarboard surface, like scratching, bending or overly compressing the mortarboard. Moreover, corner spacer 60 ensures that corner clip 100 does not damage the mortarboard corner.

As shown in FIG. 2B and FIG. 2C, triangular spacer 60 has a triangularly shaped top extender 62 and a triangularly shaped bottom extender 63. As shown in FIG. 1B and FIG. 2B, top extender 62 has top extender front edge 64, top extender top surface 65, and top extender bottom surface 66. As shown in FIG. 2B, top extender 62 has top extender first back edge 81 and top extender second back edge 82. Top extender first back edge 81 forms an approximately 45 degree angle with top extender front edge 64. Likewise, top extender second back edge 82 forms an approximately 45 degree angle with top extender front edge 64. Top extender first back edge 81 and top extender second back edge 82 form an approximately 90 degree angle with respect to each other.

As shown in FIG. 1B, bottom extender 63 has bottom extender front edge 67, bottom extender top surface 68, and bottom extender bottom surface 69. As shown in FIG. 2C, bottom extender 63 has bottom extender first back edge 83 and bottom extender second back edge 84. Bottom extender first back edge 83 forms an approximately 45 degree angle with bottom extender front edge 67. Likewise, bottom extender second back edge 84 forms an approximately 45 degree angle with bottom extender front edge 67. Bottom extender first back edge 83 and top extender second back edge 84 form an approximately 90 degree angle with respect to each other.

As shown in FIG. 1B, when corner clip 100 is clipped to a mortarboard, top extender bottom surface 66 is in close proximity, or is flush against a portion of the mortarboard top surface. Likewise, when corner clip 100 is clipped to a mortarboard, bottom extender top surface 68 lies in close proximity to, or is flush against a portion of the mortarboard bottom surface.

As shown in FIG. 1B, triangular spacer 60 may connect to both upper prong 20 and lower prong 30. Top extender front edge 64 may connect to upper prong back edge 25. Bottom extender front edge 67 may connect to lower prong back edge 35. In one embodiment, top surface 21 of upper prong 20 may be even with top extender top surface 65 after triangular spacer 60 is joined to upper prong 20. Likewise, bottom surface 22 of upper prong 20 may be even with top extender bottom surface 66 after triangular spacer 60 is joined to upper prong 20. In this embodiment, a portion of the mortarboard's top surface may be in proximity to, or flush against, both bottom surface 22 and top extender bottom surface 66.

In another embodiment, top surface 31 of lower prong 30 may be even with bottom extender top surface 68 after triangular spacer 60 is joined to lower prong 30. Likewise, bottom surface 32 of lower prong 30 may be even with bottom extender bottom surface 69 after triangular spacer 60 is joined to lower prong 30. In this embodiment, a portion of the mortarboard's bottom surface may be in proximity to, or flush against, top surface 31 and bottom extender top surface 68.

As shown in FIG. 2B and FIG. 2C, triangular spacer 60 has top extender 62 joined to bottom extender 63 by at least one, but preferably two spacer portions. In one embodiment, the two spacer portions may be first spacer portion 85 and second spacer portion 90.

First spacer portion 85 is an elongated U-shaped groove with two legs, first spacer leg 86 and second spacer leg 87. First spacer portion 85 also has spacer body 88 forming apex of U-shaped first spacer portion 85. First spacer leg 86 fixably secures to top extender first back edge 81 and second spacer leg 87 fixably secures to bottom extender first back edge 83.

Spacer body 88 holds first spacer leg 86 and second spacer leg 87 in an orientation to accommodate the thickness of a mortarboard such that top extender bottom surface 66 lies substantially flush against a portion of the top surface of the mortarboard, and bottom extender top surface 68 lies substantially flush against a portion of the bottom surface of the mortarboard.

In a preferred embodiment, triangular spacer 60 includes not only first spacer portion 85, but also second spacer portion 90. Second spacer portion 90 is an elongated U-shaped groove with two legs, first spacer leg 91 and second spacer leg 92. Second spacer portion 90 also has spacer body 93 forming apex of U-shaped second spacer portion 90. First spacer leg 91 fixably secures to top extender second back edge 82 and second spacer leg 92 fixably secures to bottom extender second back edge 84. Spacer body 93 holds first spacer leg 91 and second spacer leg 92 in an orientation to accommodate the thickness of a mortarboard such that top extender bottom surface 66 lies substantially flush with a portion of the top surface of the mortarboard, and bottom extender top surface 68 lies substantially flush with a portion of the bottom surface of the mortarboard.

4. Receiving Well

As shown in FIG. 1A, FIG. 1B, FIG. 2A, and FIG. 2B, receiving well 70 includes wall 71 supported by base 72 located on top surface 21. Wall 71 has a ring-shaped cross section defining interior space 73 surrounded by interior surface 74. Wall 71 has wall top 75 which is the top surface of the ring-shaped cross section. Base 72 may also have a ring-shaped cross section defining the same interior space 73 surrounded by the same interior surface 74 as wall 71. Interior space 73 should extend into and through base 72. Interior surface 74 is shared by both wall 71 and base 72.

In one embodiment, there may be an opening in top surface 21, thereby extending interior space 73 and interior surface 74 down and into upper prong 20. The opening in top surface 21 may extend through the entire thickness of upper prong 20, thereby extending interior space 73 and interior surface 74 through upper prong 20.

In one embodiment, receiving well 70 is located on a portion of top surface 21 such that receiving well 70 is resides in closer proximity to upper prong front edge 24 than to upper prong back edge 25. This desirable embodiment places the weight of receiving well 70 away from the mortarboard edge and lessens any chance of the mortarboard bending by reducing torque on the mortarboard.

B. Display Supporter Portion

The display supporter portion has a first display leg and a second display leg, both legs joined by a holding member that holds first display leg and second display fixably in place such that they are parallel to each other. The display supporter portion also has a neck connected to the holding member and an elongated arm connected to the neck. The elongated arm joins the display supporter portion to the board clip portion. The neck may be straight or curved. A straight supporter is a display supporter portion with a straight neck. A curved supporter is a display supporter portion with a curved neck.

Figure 3:
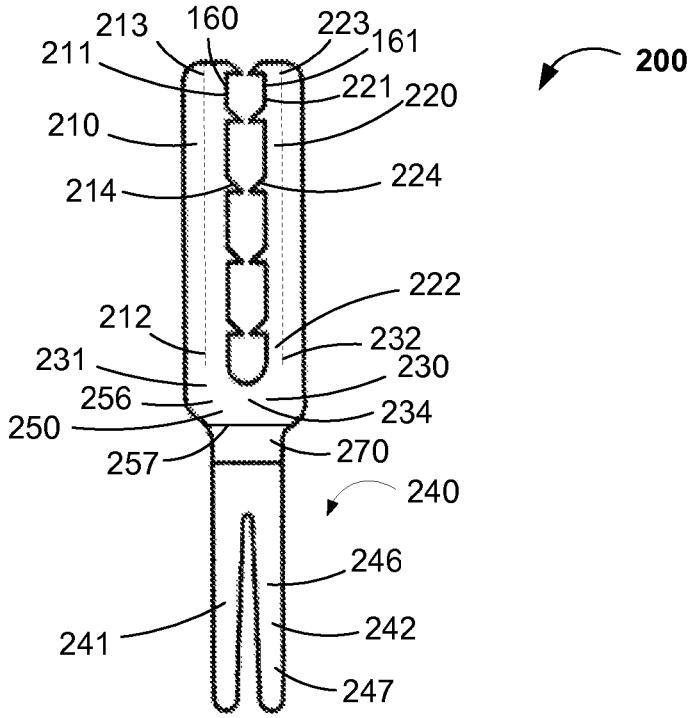
FIG. 3 shows a side view of a straight supporter, a display supporter portion designed to support a displayed document, sign, drawing, photograph, or display perpendicularly with respect to the plane of the mortarboard.
Figure 5:
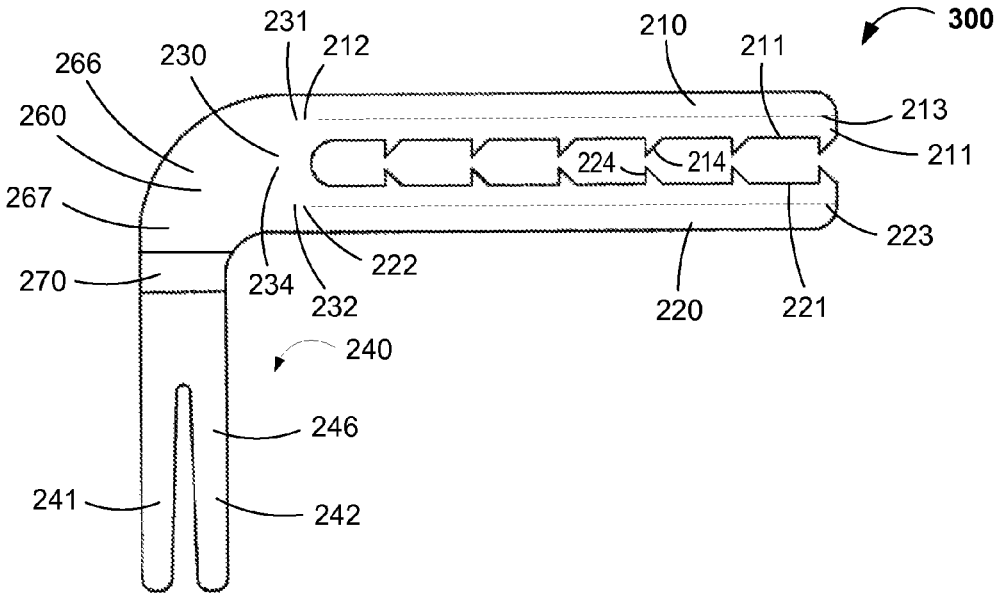
FIG. 5 shows a side view of a curved supporter, a display supporter portion designed to support a displayed document, sign, drawing, photograph, or display in parallel with respect to the plane of the mortar board.

As shown in FIG. 3 and FIG. 5, a display supporter portion may be either straight supporter 200 or curved supporter 300. Straight supporter 200 and curved supporter 300 each has a first display leg 210 and a second display leg 220. The displayed document, sign, drawing, and/or photograph is held between first display leg 201 and second display leg 220. Holding member 230 holds first display leg 210 and second display leg 220 fixably in place and parallel to each other. Straight supporter 200 and curved supporter 300 each has elongated arm 240, which may comprise two arm portions, first arm portion 241 and second arm portion 242. Straight supporter 200 has straight neck 250 connecting holding member 230 to arm 240. Curved supporter 300 has curved neck 260 connecting holding member 230 to arm 240.

1. First Display Leg

As shown in FIG. 3, FIG. 4, FIG. 5, and FIG. 6, first display leg 210 is flat and has a flat inner surface 211 and first display leg back edge 212. First display leg plane 213 extends throughout first display leg 210 and is parallel to inner surface 211. First ridges 214 are attached to inner surface 211. First ridges 214 may be a plurality of parallel ridges, numbering between 2 and 8 ridges, and ideally numbering between 4 and 6 ridges.

Figure 4:
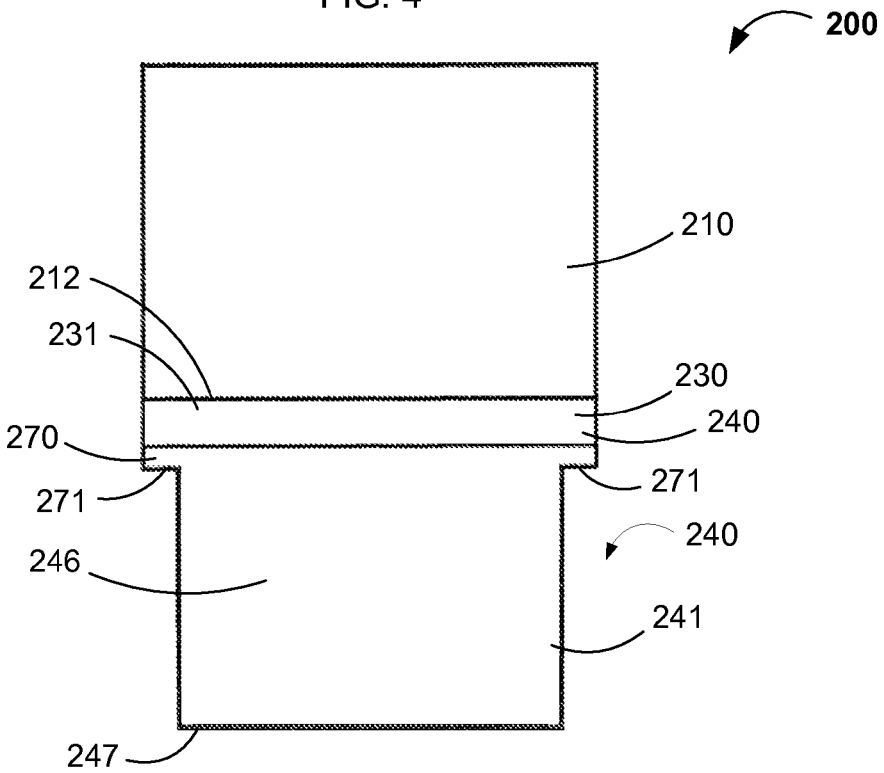
FIG. 4 shows the front view of a straight supporter.

As shown in FIG. 4, first display leg 210 has a shape, and that shape may be square, rectangular, triangular, circular, oval, trapezoidal, or an irregular shape. First display leg plane 213 extends through first display leg 210 no matter what its shape.

2. Second Display Leg

Figure 6:
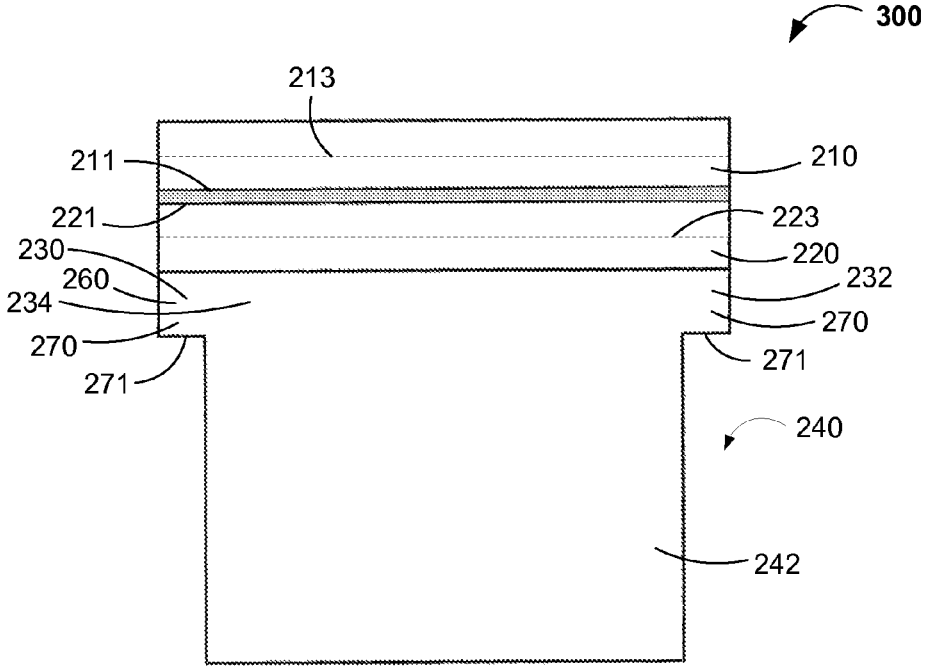
FIG. 6 shows the rear view of a curved supporter.

As shown in FIG. 3, FIG. 5, and FIG. 6, second display leg 220 is flat and has a flat inner surface 221 and second display leg back edge 222. Second display leg plane 223 extends throughout second display leg 220 and is parallel to inner surface 221. Second ridges 224 are attached to inner surface 221. Second ridges 224 may be a plurality of parallel ridges, numbering between 2 and 8 ridges, and ideally numbering between 4 and 6 ridges.

Second display leg 220 has a shape, and that shape may be square, rectangular, triangular, circular, oval, trapezoidal, or an irregular shape. Second display leg plane 223 extends through first display leg 220 no matter what its shape.

3. Holding Member

As shown FIG. 3 and FIG. 5, holding member 230 fixably holds both first display leg 210 and second display leg 220 such that first display leg plane 213 is substantially parallel to second display leg plane 223. For purposes of this invention, substantially parallel is defined as any angle less than about 10 degrees, preferably less than about 5 degrees, and more preferably less than about 3 degrees. In one embodiment, first display leg 210 and second display leg 220 are less than about 3 mm apart, preferably less than about 2 mm apart.

Holding member 230 is a U-shaped member with two legs, first holding leg 231 and second holding leg 232. Holding member 230 also has holding body 234 forming apex of the U-shaped member. First holding leg 231 connects to first display leg back edge 212 and second spacing leg 232 connects to second display leg back edge 222. Holding body 234 holds first display leg 210 and second display leg 220 in a substantially parallel orientation to securely support a piece of paper between the two legs.

4. Neck and Arm

As shown in FIG. 3, FIG. 4, FIG. 5, and FIG. 6, display supporter portion has a neck that connects to holding member 230 and also connects to arm 240. The neck may be straight or curved.

Figure 7:
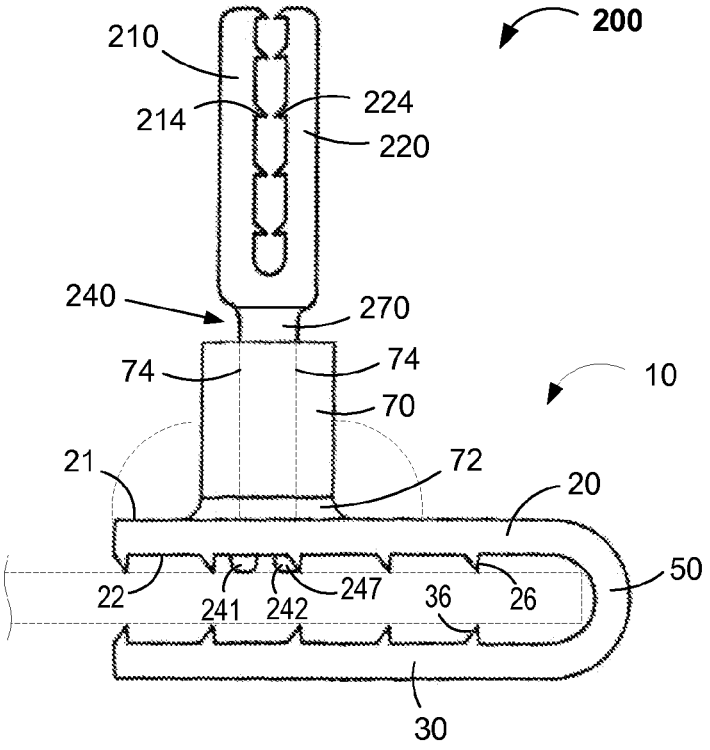
FIG. 7 shows a side view of a mortar board display holder comprising a straight supporter connected to an edge clip.
Figure 8:
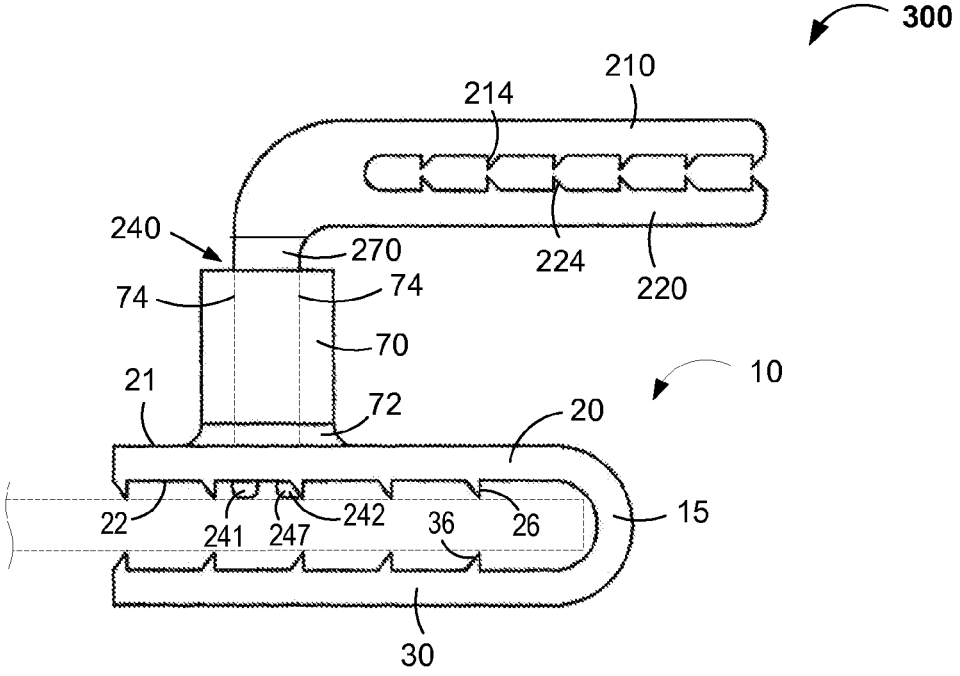
FIG. 8 shows a side view of a mortar board display holder comprising a curved supporter connected to an edge clip.
Figure 9:
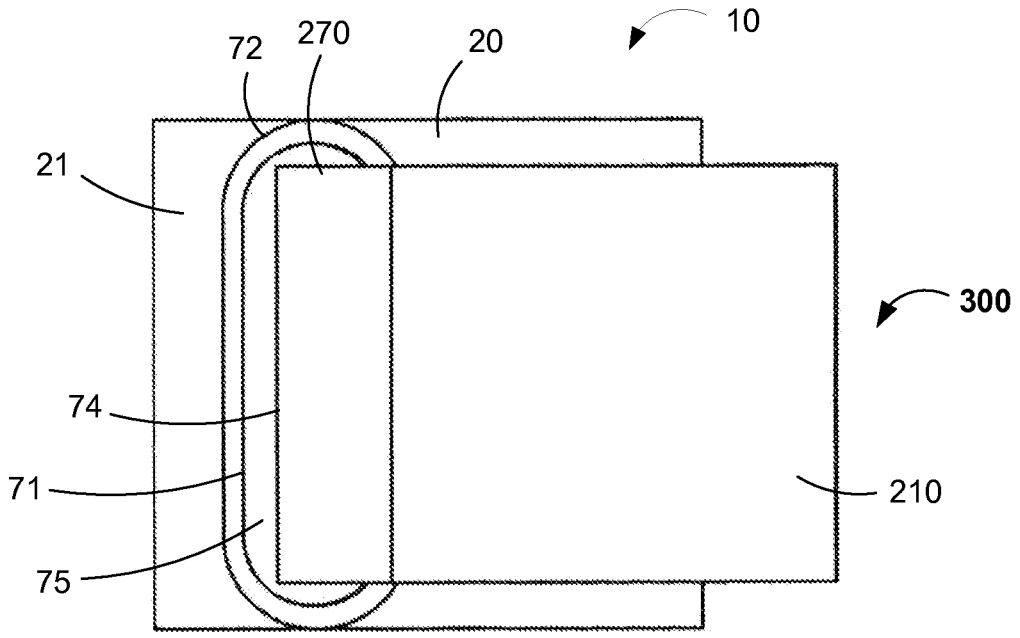
FIG. 9 shows a top view of a mortarboard display holder comprising a curved supporter connected to an edge clip.

Arm 240 has arm body 246 and arm end 247. As shown in FIG. 7, FIG. 8, and FIG. 9, arm 240 is elongate in shape and is designed to extend through receiving well 70 to connect with and secure to the board clip portion. Arm body 246 extends through interior space 73 of receiving well 70. The surface of arm body 246 may frictionally contact interior surface 74 of receiving well 70, and the friction holds arm 240 in place within receiving well 270.

In one embodiment, arm end 247 may have a hook that engages bottom surface 22 of top prong 20.

As shown in FIG. 3, FIG. 5, FIG. 7 and FIG. 8, arm 240 may comprise first arm portion 241 and second arm portion 242. First arm portion 241 has first arm body and first arm end. Second arm portion has second arm body and second arm end. First arm end may have a hook and second arm end may have a hook. When first arm portion 241 and second arm portion 242 extend through receiving well 270, the two hooks can each engage bottom surface 22 of top prong 20.

i. Straight Supporter

As shown in FIG. 3, when a display supporter portion has straight neck 250 securely joining holding member 230 and arm 240, then the display supporter portion is embodied as straight supporter 200, adapted to hold a document, display, drawing, or photograph substantially perpendicularly with respect to the plane of the mortarboard.

Straight neck 250 has leg side 256 connected to holding member 230 and arm side 257 connected to arm 240. As shown in FIG. 3, arm 240 comprises first arm portion 241 and second arm portion 242.

ii. Curved Supporter

As shown in FIG. 5, when a display supporter portion has curved neck 260 securely joining holding member 230 and arm 240, then the display supporter portion is embodied as curved supporter 300, adapted to hold a document, display, drawing, or photograph substantially in parallel with respect to the plane of the mortarboard.

Curved neck 260 has leg side 266 and arm side 267. Leg side 266 can connect to holding member 230 and arm side 267 can connect to arm 240. As shown in FIG. 5, arm 240 comprises first arm portion 241 and second arm portion 242.

As shown in FIG. 5, curved neck 260 may be curved such that second display leg plane 223 forms an angle between 0 degrees and 90 degrees with respect to the line extending through arm body 246. Alternatively, curved neck 260 may be curved such that first display leg plane 213 forms an angle between 0 degrees and 90 degrees with respect to the line extending through arm body 246.

C. Connecting Means

In order for mortarboard display holder to clip to a mortarboard and display a document, the board clip portion must connect to display supporter portion through a connecting means. In one embodiment, the connecting means is arm 240 extending into receiving well 70 and securing to upper prong 20. Preferably, as shown in FIG. 7 and FIG. 8, arm body 246 extends through interior space 73 of receiving well 70. The surface of arm body 246 may frictionally contact interior surface 74 of receiving well 70, and the friction holds arm 240 in place within receiving well 70. A hook located on arm end 247 may contact bottom surface 22 of top prong 20.

If arm 240 comprises first arm portion 241 and second arm portion 242, then first arm portion 241 and second arm portion 242 may each bias against interior surface 74 and increase the frictional contact between holding arm 240 and interior surface 74. A hook on the end of each of first arm portion 241 and second arm portion 242 may contact bottom surface 22 of top prong 20.

In one embodiment of the connecting means, display supporter portion further comprises a shoulder portion that can contact and engage wall top 75. As shown in FIGS. 3-8, in this embodiment of the display supporter portion, shoulder 270 is located between the neck and the elongated arm. Shoulder 70 has a shoulder edge 271 that contacts wall top 75 to secure the connection between the display supporter portion and the board clip portion. Shoulder edge 271 will ensure that the display supporter portion will stay in place within receiving well 70. Shoulder edge 271 will contact wall top 75 and ensure that arm end 247 will not rest heavily on top of the mortarboard surface and indent the surface.

As shown in FIG. 7, a mortarboard display holder may be embodied as edge clip 10 connected to straight supporter 200. In this embodiment, the angle between upper plane 23 (See FIG. 1A) and first display leg plane 213 (see FIG. 3) can be between 0 and 90 degrees, but preferably is approximately 90 degrees. Also in this embodiment, the angle between upper plane 23 (See FIG. 1A) and second display leg plane 223 (see FIG. 3) can be between 0 and 90 degrees, but preferably is approximately 90 degrees. Upper ridges 26 and lower ridges 36 securely hold edge clip 10 to a mortarboard.

First ridges 214 and second ridges 224 allow straight supporter 200 to securely support a document, display, sign, drawing, or photograph. As shown in FIG. 4 and FIG. 7, shoulder 70 has lower shoulder edge 271 that contacts wall top 75 to secure the connection between the display supporter portion and the board clip portion. The combination of edge clip 10 and straight supporter 200 can hold a document, display, sign, drawing, or photograph substantially perpendicularly to the mortarboard plane.

As shown in FIG. 8 and FIG. 9, a mortarboard display holder may be embodied as edge clip 10 connected to curved supporter 300. In this embodiment, upper plane 23 (see FIG. 1A) is substantially parallel to both first display leg plane 213 (see FIG. 3) and second display leg plane 223 (see FIG. 3). Upper ridges 26 and lower ridges 36 securely hold edge clip 10 to a mortarboard. First ridges 214 and second ridges 224 allow straight supporter 200 to securely support a document, display, sign, drawing, or photograph.

FIG. 9 shows how first display leg 210 can extend over and in parallel to upper prong 20. Shoulder 270 contacts wall top 75 when arm 240 extends through well 70 and biases against interior surface 74. Upper plane 23 is substantially parallel to top surface 21 of upper prong 20. The combination of edge clip 10 and curved supporter 300 can hold a document, display, sign, drawing, or photograph substantially in parallel to the mortarboard plane.

A number of embodiments of the invention have been described. Nevertheless, it will be understood that various modifications may be made without departing from the spirit and scope of the invention. Accordingly, other embodiments are within the scope of the present invention.

We claim:

1. A method of supporting a display material on a graduation mortarboard comprising:

acquiring a display material, wherein said display material may be chosen from a group consisting of: a document, a sign, a drawing, and a photograph;

obtaining a graduation mortarboard;

identifying a flat top on said graduation mortarboard;

defining an edge of said flat top;

procuring a mortarboard display holder, wherein said mortarboard display holder has a board clip portion, a display supporter portion, and a connecting portion, wherein said board clip portion has a flat upper prong having an inner surface having a first inner plane, a flat lower prong having an inner surface having a second inner plane, and a spacing member that holds said upper prong fixably spaced from said lower prong such that said second inner plane forms an angle that is less than five degrees with said first inner plane, wherein said display supporter portion has a flat first leg having an inner surface having a third inner plane, a flat second leg having an inner surface having a fourth inner plane, and a holding member that holds said first leg and said second leg such that said third inner plane forms an angle that is less than five degrees with said fourth inner plane, and wherein said connecting portion joins said board clip portion to said display supporter portion;

clipping said board clip portion to said edge;

and supporting said display material in said display supporter portion.

* * * * *